US005630366A

United States Patent [19]

Lesoille

[11] Patent Number: 5,630,366

[45] Date of Patent: May 20, 1997

[54] PROCESS FOR AUTOTHERMAL INCINERATION OF SLUDGE AND OPTIONALLY IN ADDITION OF HOUSEHOLD REFUSE

[75] Inventor: Marcel Lesoille, Bougival, France

[73] Assignee: Degremont, Reuil-Malmaison, France

[21] Appl. No.: 513,694

[22] Filed: Aug. 11, 1995

[30] Foreign Application Priority Data

Aug. 29, 1994 [FR] France ..... 94 10378

[51] Int. Cl.[6] ..... F23G 5/04

[52] U.S. Cl. ..... 110/221; 110/224

[58] Field of Search ..... 110/221, 224, 110/226, 205

[56] References Cited

U.S. PATENT DOCUMENTS

| | | | |
|---|---|---|---|
| 2,246,224 | 6/1941 | Streander | 110/221 |
| 3,529,558 | 9/1970 | Tanner | 110/224 |
| 3,670,669 | 6/1972 | Hoad | 110/221 |
| 3,714,038 | 1/1973 | Marsh | 110/221 |
| 4,656,972 | 4/1987 | Shimoda | 110/205 |

FOREIGN PATENT DOCUMENTS

| | | |
|---|---|---|
| 0166079 | 1/1986 | European Pat. Off. . |
| 1912648 | 9/1970 | Germany . |
| 1751751 | 4/1971 | Germany . |
| 80/01407 | 7/1980 | WIPO . |
| 93/00562 | 1/1993 | WIPO . |

*Primary Examiner*—Noah P. Kamen

*Attorney, Agent, or Firm*—Pollock, Vande Sande & Priddy

[57] ABSTRACT

Process for autothermal incineration of sludge originating from urban and/or industrial water purification stations and of household refuse, wherein it consists in carrying out a dehydration of the sludge by centrifuging-drying while employing the sensible heat of the fumes produced in the incineration furnace, the said dehydrated sludge being introduced, in pulverulent form, into the incineration furnace at the same time as the household refuse.

10 Claims, 1 Drawing Sheet

PROCESS FOR AUTOTHERMAL INCINERATION OF SLUDGE AND OPTIONALLY IN ADDITION OF HOUSEHOLD REFUSE

FIELD OF THE INVENTION

The present invention relates to a process for autothermal incineration of sludge originating from urban and/or industrial water purification stations. According to a second aspect of this invention, this process can be used to incinerate sludge and household refuse simultaneously.

BACKGROUND OF THE INVENTION

The possibility of incinerating liquid sludge and household refuse in a combined treatment has already been examined. Past efforts introduce sludge cakes exhibiting a sufficient dryness, with household refuse, directly into an incineration furnace. However, such a process has limitations, especially with regard to the proportion of dried sludge in relation to the household refuse and is thus difficult to exploit. Investigations have also been made into processes using a recovery of the heat energy produced by the incineration of household refuse in order to carry out the drying of the sludge which is then incinerated together with the household refuse.

BRIEF SUMMARY OF THE INVENTION

The present invention is intended to improve the last abovementioned process. A first aspect is a process for autothermal incineration of the sludge originating from urban and/or industrial water purification stations. Dehydration of the sludge occurs by centrifuging-drying while employing heat from fumes produced in the incineration furnace. Dehydrated sludge, in pulverulent form, is introduced into the incineration furnace.

According to a second aspect, this invention relates to a process for autothermal incineration of sludge originating from urban and/or industrial water purification stations and of household refuse. Dehydration of the sludge occurs by centrifuging-drying, while employing heat from fumes produced in the incineration furnace. Dehydrated sludge is introduced, in pulverulent form, into the incineration furnace at the same time as the household refuse.

According to the present invention, the sludge originating from the centrifuging-drying stage may be reintroduced into the incineration furnace in order to destroy the noncondensable matter and to recirculate the necessary oxidizing and dilution air.

According to another characteristic of the invention, the fumes produced in the incineration furnace are diluted before the centrifuging-drying stage by the introduction of dilution air.

According to yet another characteristic of the process according to the invention, the fumes produced in the incineration furnace are conditioned before recovery of their heat during the stage of centrifuging-drying of the sludge. This conditioning, carried out in a reaction chamber, simultaneously ensures a preliminary dust removal and a recrystallization of the purges originating from the final stage of treatment of the fumes.

The process forming the subject of this invention, and a plant for its use, will now be described in detail. This description refers to the embodiment according to which dried sludge and household refuse are incinerated simultaneously. It remains clearly understood that the process according to the invention may be used, as has been specified above, for the incineration only of the sludge dried according to the process defined above.

BRIEF DESCRIPTION OF THE DRAWINGS

The above-mentioned objects and advantages of the present invention will be more clearly understood when considered in conjunction with the accompanying drawings, in which.

DETAILED DESCRIPTION OF THE INVENTION

Figure 1:
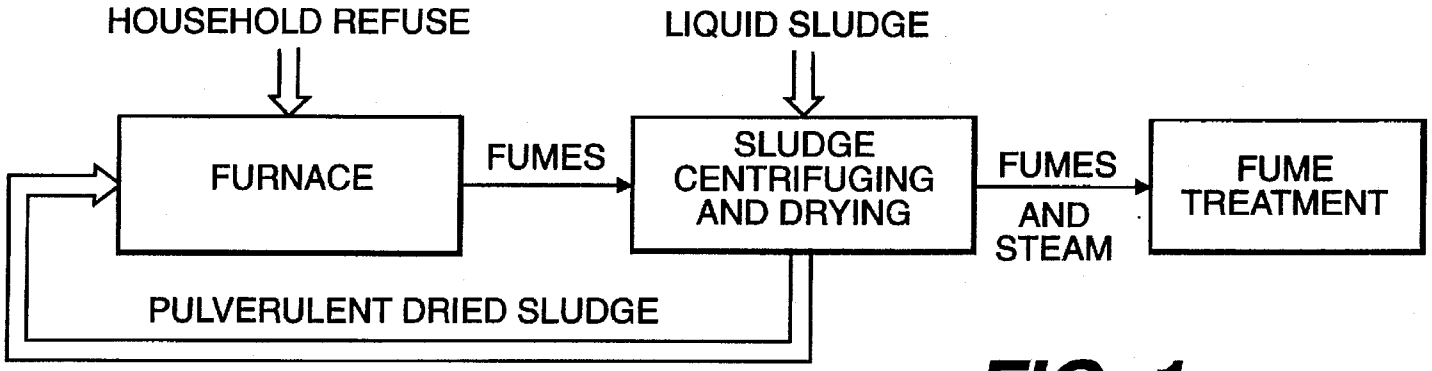
FIG. 1 is a block diagram illustrating the stages of the process which forms the subject of the invention.

As can be seen diagrammatically in FIG. 1, the combustion fumes originating from the incineration furnace are employed in order to ensure the drying of the liquid sludge, which is simultaneously subjected to a centrifuging operation making it possible to obtain a high degree of dryness (higher than 65%). The dried sludge, reduced to a pulverulent state, is introduced into the incineration furnace at the same time as the household refuse. The fumes and the steam resulting from the drying are then subjected to a treatment which may be conventional.

The process according to the present invention enables sludge and household refuse to be treated simultaneously, in a weight ratio which is unlimited. This is unknown in the prior art.

Figure 2:
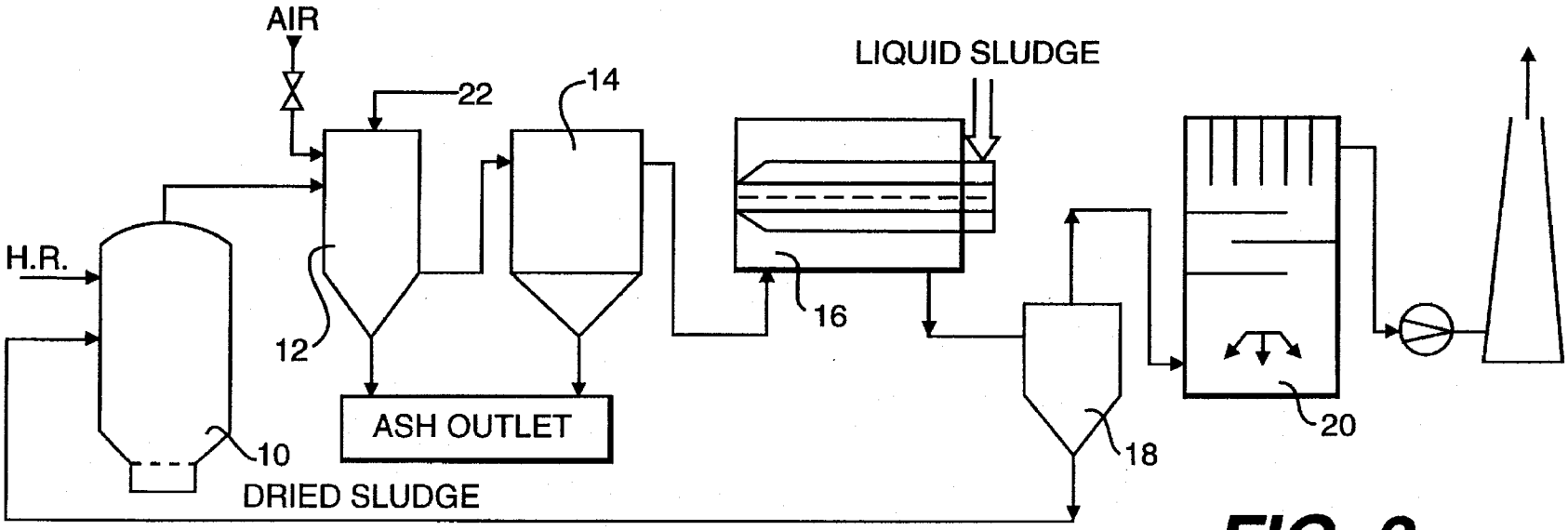
FIG. 2 is a diagrammatic representation of an example of an embodiment of a plant for autothermal incineration making use of the process forming the subject of the invention.

FIG. 2 is a diagram which illustrates an embodiment of a plant for making use of the process defined above. It is seen that this plant includes, essentially, the following components:

- an incineration furnace 10, preferably a fluidized bed furnace, receiving, on the one hand, household refuse (H.R.) and, on the other hand, the sludge dried according to the process specified above;
- a dilution and spraying chamber 12 making it possible to carry out a conditioning of the fumes, the heat of which is subsequently employed according to the invention in order to carry out the drying of the liquid sludge in the dryer-centrifuge 16 described below;
- a filter, preferably a bag filter 14, allowing the ash to be separated from the combustion fumes;
- a dryer-centrifuge device 16, which may be of any known type. The liquid sludge is delivered to device 16 and, after centrifuging and drying, employing the heat of the combustion gases originating from the incinerator 10, it is possible to obtain pulverulent dry sludge exhibiting a high degree of dryness. This pulverulent sludge is introduced into the incinerator 10 with the household refuse, as mentioned above. The separation of the steam and of the dried sludge is performed in a cyclone 18, the fumes and the steam being subsequently treated in a conventional final plant 20 before being discharged through a chimney.

The process forming the subject of the invention makes it possible to produce compact treatment units in which the dehydration of the sludge is incorporated in line into the circuit for treatment of the fumes from the incineration unit.

According to the invention, a dilution of the fumes leaving the incinerator 10 is carried out with the aid of a flow of air, which lowers the temperature of the fumes from 900° to approximately 200° C. while conserving heat, the energy needed for the drying being taken from this heat, as has already been mentioned.

The dilution reaction chamber 12 is used as a preliminary dust separator and crystallization chamber for purges originating from the final treatment of the fumes, these purges being introduced at 22 into the chamber 12. The purges are from the treatment unit 20, and this makes it possible to perform the dilution and the removal of the solid contaminants.

According to the invention, the steam which originates from the drying of the sludge in the dryer-centrifuge 16 may be reintroduced into the incineration furnace 10 in order to destroy the noncondensable matter and to recirculate the necessary oxidizing and dilution air while also making it possible to employ the heat present in this steam. This can avoid preheating of the air for combustion and/or fluidization when the incineration furnace 10 is a fluidized bed furnace.

In summary, the advantages provided by the process forming the subject of the invention are:

production of plants which are much more compact than existing plants primarily due to elimination of the recovery boiler;

possibility of carrying out a dilution (chamber 12) permitting the treatment of the deconcentration flow, by a very fast passage in the region of temperatures promoting the formation of dioxins;

simplification of the furnace feed system such as elimination of plunger pumps. The feeding of the furnace 10 with pulverulent dried sludge is performed by pneumatic conveying;

reduction in capital costs by virtue of the production of compact plants and reduction in operation charges. The dehydration and the incineration are combined in a compact unit which can be easily automated, which makes it possible to lower the maintenance and servicing costs.

It remains quite obvious that the present invention is not limited to the methods of use and to the example of embodiments which are described above, but that it encompasses any alternative forms thereof.

I claim:

1. A process for autothermal incineration of sludge originating from urban an/or industrial water purifications stations and of household refuse, the steps comprising:

conveying liquid sludge for dehydration;

subjecting the sludge to centrifuging for removing liquid therefrom;

simultaneously subjecting the centrifuging sludge to heat for accelerating drying and completing the dehydration;

conveying resulting pulverizing dried sludge for incinerating the sludge;

simultaneously incinerating household refuse; and utilizing the heat of fumes generated during incinerating to dry the sludge during the dehydration step.

2. The process set forth in claim 1 wherein the dehydration step occurs upstream of the incinerating step.

3. The process set forth in claim 1 further comprising the step of reintroducing steam generated from the dehydration step into the incinerating step thereby destroying noncondensable matter and recirculating necessary oxidizing and dilution air.

4. The process set forth in claim 1 wherein the fumes produced during the incinerating step are subjected to diluting air before the dehydrating step.

5. The process set forth in claim 1 wherein the fumes are pre-conditioned in a reaction chamber prior to the dehydrating stage thereby simultaneously achieving dust removal and recrystallization of purges originating from a final treatment stage of the fumes.

6. A process for autothermal incineration of sludge originating from urban an/or industrial water purifications stations, the steps comprising:

conveying liquid sludge for dehydration;

subjecting the sludge to centrifuging for removing liquid therefrom;

simultaneously subjecting the centrifuging sludge to heat for accelerating drying and completing the dehydration thus resulting in pulverizing dried sludge having a dryness greater than 65%;

conveying resulting pulverizing dried sludge for incinerating the sludge; and utilizing the heat of fumes generated during incinerating to dry the sludge during the dehydration step.

7. The process set forth in claim 6 wherein the dehydration step occurs upstream of the incinerating step.

8. The process set forth in claim 6 further comprising the step of reintroducing steam generated from the dehydration step into the incinerating step thereby destroying noncondensable matter and recirculating necessary oxidizing and dilution air.

9. The process set forth in claim 6 wherein the fumes produced during the incinerating step are subjected to diluting air before the dehydrating step.

10. The process set forth in claim 6 wherein the fumes are pre-conditioned in a reaction chamber prior to the dehydrating stage thereby simultaneously achieving dust removal and recrystallization of purges originating from a final treatment stage of the fumes.

* * * * *